US008294656B2

(12) United States Patent
Park et al.

(10) Patent No.: US 8,294,656 B2
(45) Date of Patent: Oct. 23, 2012

(54) SIGNAL CONTROL DEVICE, LIQUID CRYSTAL DISPLAY HAVING THE SAME AND SIGNAL CONTROL METHOD USING THE SAME

(75) Inventors: Jae-Hyoung Park, Ansan-si (KR); Woo-Chul Kim, Uijeongbu-si (KR)

(73) Assignee: Samsung Display Co., Ltd., Yongin (KR)

( * ) Notice: Subject to any disclaimer, the term of this patent is extended or adjusted under 35 U.S.C. 154(b) by 1189 days.

(21) Appl. No.: 11/832,958

(22) Filed: Aug. 2, 2007

(65) Prior Publication Data

US 2008/0030487 A1 Feb. 7, 2008

(30) Foreign Application Priority Data

Aug. 3, 2006 (KR) ..... 10-2006-0073455

(51) Int. Cl.
*G09G 3/36* (2006.01)

(52) U.S. Cl. ..... 345/99

(58) Field of Classification Search ..... 375/130–377
See application file for complete search history.

(56) References Cited

U.S. PATENT DOCUMENTS

| | | | | |
|---|---|---|---|---|
| 5,307,085 | A * | 4/1994 | Nakamura | 345/99 |
| 5,898,442 | A * | 4/1999 | Takebe | 345/531 |
| 6,229,513 | B1 * | 5/2001 | Nakano et al. | 345/99 |
| 6,487,614 | B2 * | 11/2002 | Nobutani et al. | 710/20 |
| 2004/0125068 | A1 * | 7/2004 | Lee | 345/99 |
| 2004/0228199 | A1 * | 11/2004 | Oda | 365/232 |
| 2006/0001632 | A1 * | 1/2006 | Katagawa | 345/98 |

* cited by examiner

*Primary Examiner* — Amr Awad
*Assistant Examiner* — Kenneth Bukowski
(74) *Attorney, Agent, or Firm* — H.C. Park & Associates, PLC

(57) ABSTRACT

Disclosed are a signal control device and a liquid crystal display device having the same. The signal control device includes receivers and data storage units. The receivers receive clock signals and data signals through channels. The data storage units are provided according to channels and store the data signals transmitted through corresponding channels. In addition, the data storage units substantially simultaneously output the data signals in synchronization with a specific clock signal selected from the received clock signals received through the channels.

13 Claims, 5 Drawing Sheets

SIGNAL CONTROL DEVICE, LIQUID CRYSTAL DISPLAY HAVING THE SAME AND SIGNAL CONTROL METHOD USING THE SAME

CROSS-REFERENCE TO RELATED APPLICATION

This application claims priority from and the benefit of Korean Patent Application No. 10-2006-0073455, filed on Aug. 3, 2006, which is hereby incorporated by reference for all purposes as if fully set forth herein.

BACKGROUND OF THE INVENTION

1. Field of the Invention

The present invention relates to a signal control device, a display device having the same, and a signal control method using the same. More particularly, the present invention relates to a signal control device that may be capable of compensating for data skew, a display device having the signal control device, and a signal control method using the signal control device.

2. Discussion of the Background

In general, a display device includes a display panel to display an image, a driver to drive the display panel, and a timing controller that provides a data signal and a control signal to the driver.

The timing controller receives control signals including a predetermined clock signal and data signals synchronized with the clock signal from an external graphics controller. The timing controller processes the control signals and the data signals before providing them to the driver. The driver provides various types of control signals and data signals to the display panel in synchronization with the clock signal from the timing controller so that the display panel may display an image.

In a high definition display device, data may be communicated between the timing controller and the graphics controller through a plurality of channels. In this case, a delay difference called "skew" may occur between signals of the channels. The skew may be caused by various factors such as circuit element characteristics, printed circuit board (PCB) patterns, etc.

As the number of channels increases, skew occurring between the channels is more serious than skew between signals in each channel.

SUMMARY OF THE INVENTION

The present invention provides a signal control device that may be capable of compensating for skew occurring between channels.

The present invention also provides a liquid crystal display employing the signal control device.

The present invention also provides a signal control method for the liquid crystal display.

Additional features of the invention will be set forth in the description which follows, and in part will be apparent from the description, or may be learned by practice of the invention.

The present invention discloses a signal control device including a plurality of receivers, a plurality of data storage units, and a controller. The receivers receive and output data signals, clock signals, and data enable signals. The data storage units receive the data signals and the clock signals output from the receivers through channels. The data storage units store the data signals in response to corresponding write signals and output the stored data signals by commonly responding to an activated read signal. The controller provides the activated read signal to the data storage units in response to a data enable signal and any one clock signal among the clock signals output from the receivers through channels. The controller also provides the write signals to the storage units while reading out the data signals from the data storage units.

The present invention also discloses a liquid crystal display including a liquid crystal display panel to display an image, a driver to drive the liquid crystal display panel, and a timing controller to receive data signals and clock signals from an exterior through a plurality of channels and to apply the data signals and the clock signals to the driver. The timing controller includes a signal control unit that outputs the data signals input through the channels. The data signals are output in synchronization with any one clock signal of the clock signals input through the channels.

The present invention also discloses a signal controlling method that includes receiving N clock signals and N data signals, which are synchronized with the N clock signals, from an external system through N channels. The received N data signals are written in N storage units in order of their reception time. One clock signal is extracted from the N clock signals, and the N data signals written in the N storage units are output simultaneously in synchronization with the extracted clock signal. In the method, N is a natural number that is greater than or equal to 2.

It is to be understood that both the foregoing general description and the following detailed description are exemplary and explanatory and are intended to provide further explanation of the invention as claimed.

DETAILED DESCRIPTION OF THE ILLUSTRATED EMBODIMENTS

Figure 1:
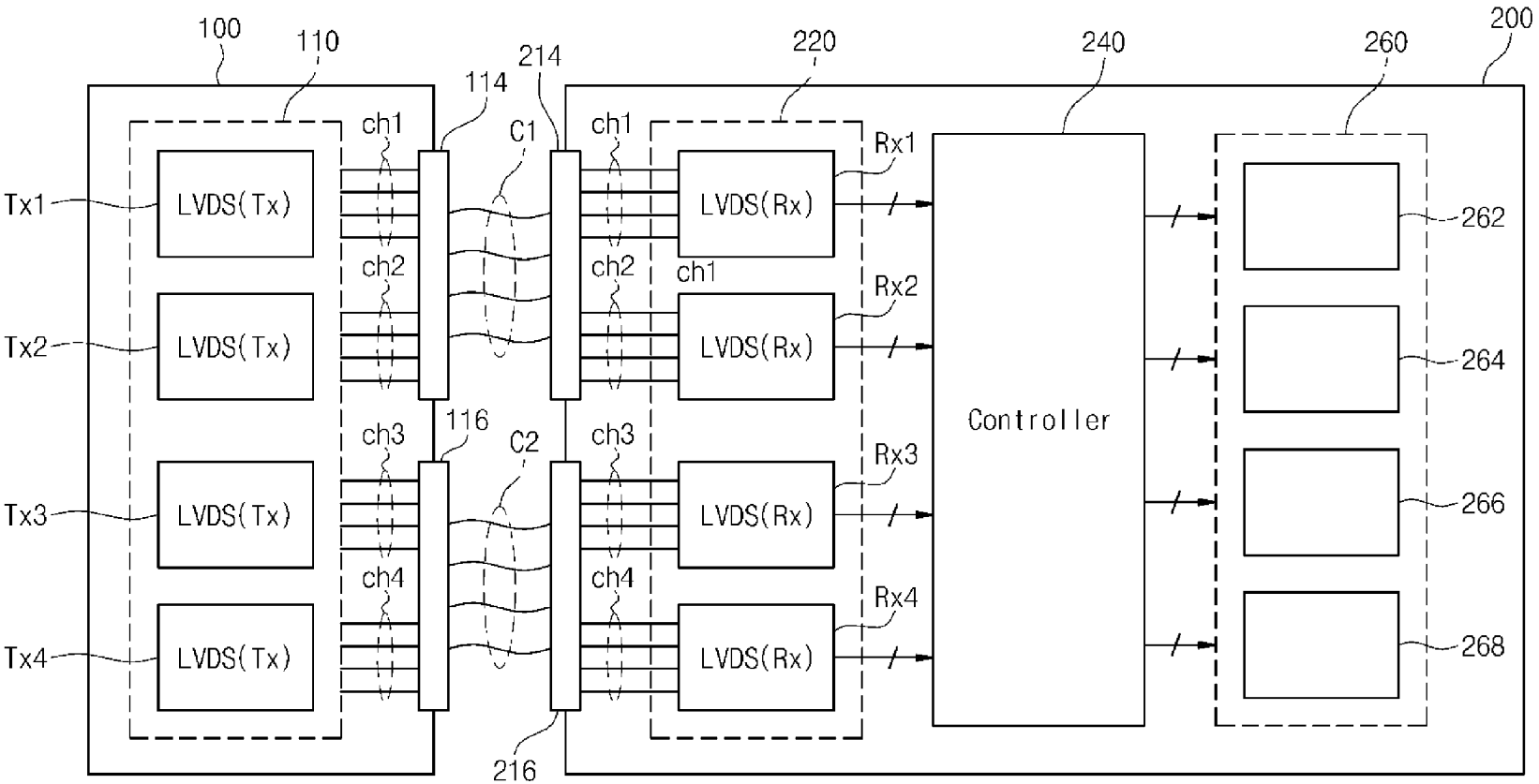
FIG. 1 is a block diagram showing a signal control device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

FIG. 1 is a block diagram showing a signal control device according to an exemplary embodiment of the present invention. In FIG. 1, the signal control device 200 is electrically connected to an external graphics controller 100.

Referring to FIG. 1, the signal control device 200 according to an exemplary embodiment of the present invention includes four receivers 220, a controller 240, and a plurality of data storage units 260.

As shown in FIG. 1, the four receivers 220 include receivers RX1, RX2, RX3 and RX4. The receivers RX1, RX2, RX3, and RX4 receive a plurality of signals, which are output according to channels, from the graphics controller 100 through two receive connectors 214 and 216 included in an end of the signal control device 200.

The graphics controller 100 includes four transmitters 110. The transmitters TX1, TX2, TX3, and TX4 transmit image data to the receivers 220 of the signal control device 200. The transmitters TX1, TX2, TX3 and TX4 output a plurality of signals to the receivers RX1, RX2, RX3, and RX4 through two transmit connectors 114 and 116 included in an end of the graphics controller 100.

The transmit connectors 114 and 116 are electrically connected to the receive connectors 214 and 216 through connection cables C1 and C2, respectively, such that data communication may occur between the graphics controller 100 and the signal control device 200.

As shown in FIG. 1, the transmitters TX1, TX2, TX3, and TX4 make point-to-point communication with the receivers RX1, RX2, RX3, and RX4 through four specified channels ch1, ch2, ch3, and ch4, respectively, which is called a parallel data communication scheme.

The channels ch1, ch2, ch3, and ch4 form data buses including a plurality of signal lines in order to guide signal groups defined as a plurality of signals. The data buses form a plurality of signal paths including data transmission paths and clock paths for the signal groups.

The transmitters TX1, TX2, TX3, and TX4 and the receivers RX1, RX2, RX3, and RX4 can be obtained through various signal processing technologies. For example, the signal processing technologies may include low voltage differential signaling (LVDS), transition minimized differential signaling (TMDS), and reduced swing differential signaling (RSDS). In the exemplary embodiments described below, the graphics controller 100 and the signal control device 200, to which the LVDS scheme is applied as transmitters TX1, TX2, TX3, and TX4 and receivers RX1, RX2, RX3, and RX4, will be described.

Although four transmitters 110 and four receivers 220 are shown in FIG. 1, these are only examples adopted to realize the signal control device 200. According to another exemplary embodiment of the present invention, there may be less than four, or five or more, transmitters 110 and receivers 220.

Figure 2:
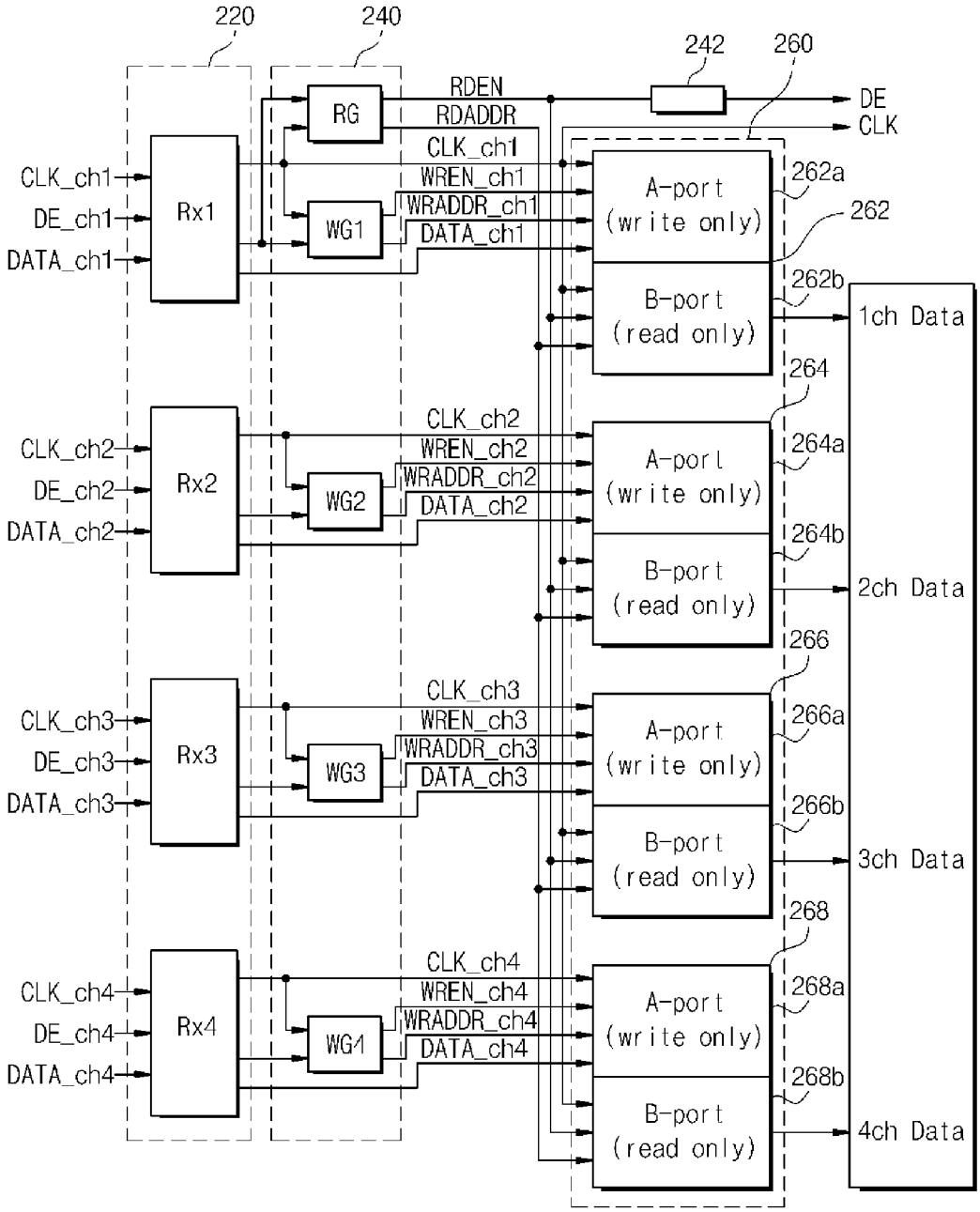
FIG. 2 is a block diagram showing an internal structure of the signal control device of FIG. 1.

The controller 240 outputs four write enable signals WREN (shown in FIG. 2) and one read enable signal RDEN (shown in FIG. 2). Details thereof will be described below.

The data storage units 260 store data signals output from the receivers 220 in response to the control signals output from the controller 240 according to channels, and then the stored data signals DATA are read out from the data storage units 260 (shown in FIG. 2).

The signal control device 200 of FIG. 1 will be described in detail below with reference to FIG. 2, which is a detailed block diagram showing an internal structure of the signal control device 200.

Referring to FIG. 2, the receivers RX1, RX2, RX3, and RX4 output signals, which are input through channels ch1, ch2, ch3, and ch4 corresponding to the receivers RX1, RX2, RX3, and RX4, to the controller 240. The signal groups input to the receivers RX1, RX2, RX3, and RX4 through the channels ch1, ch2, ch3, and ch4 include a data signal DATA, a data enable signal DE, and a clock signal CLK.

Here, skew occurring among the channels ch1, ch2, ch3, and ch4 may cause the signal groups to be applied to the receivers RX1, RX2, RX3, and RX4 at different times.

As shown in FIG. 2, the controller 240 includes one read signal generator RG and four write signal generators WG1, WG2, WG3, and WG4, which correspond one-to-one with the receivers RX1, RX2, RX3, and RX4.

The first write signal generator WG1 outputs a first write signal WREN_ch1 and a first write address signal WRADDR_ch1 in response to a first clock signal CLK_ch1 and a first data enable signal DE_ch1 output from the first receiver RX1.

The second write signal generator WG2 outputs a second write signal WREN_ch2 and a second write address signal WRADDR_ch2 in response to a second clock signal CLK_ch2 and a second data enable signal DE_ch2 output from the second receiver RX2.

The remaining write signal generators WG3 and WG4 perform the same operations as those of the first and second write signal generators WG1 and WG2, except that the same type signal groups are input thereto through different channels. Accordingly, detailed description of the write signal generators WG3 and WG4 is omitted to avoid redundancy.

The read signal generator RG may be connected to any one write signal generator (e.g., the first write signal generator WG1) among the four write signal generators WG1, WG2, WG3 and WG4 and the receiver (e.g., the first receiver RX1) corresponding to the first write signal generator WG1 in a row.

Although the read signal generator RG is connected to the first write signal generator WG1 in a row as an example in FIG. 2, the read signal generator RG may be connected to other write signal generators.

The read signal generator RG generates the read signal RDEN and a read address signal RDADDR by receiving the clock signal CLK_ch1 and the data enable signal DE_ch1 from the receiver RX1. In this case, the read signal RDEN is provided to a predetermined delay unit 242, and then output as a data enable signal DE after a predetermined time interval.

In addition, the four data storage units 262, 264, 266, and 268 of FIG. 2 temporarily store data signals transmitted according to channels. Here, skew may cause the data signals to arrive at the data storage units 262, 264, 266, and 268 through the channels at different times.

In the signal control device 200 according to an exemplary embodiment of the present invention, the data storage units 262, 264, 266, and 268 each include a dual-port random access memory (RAM) in order to compensate for data skew occurring between the channels.

The dual-port RAM inputs or outputs data in synchronization with different clock signals. The dual-port RAM includes a data storing (writing) port and a data reading port. In other words, data may be stored in the dual-port RAM through one port, and read out simultaneously from the dual-port RAM through the other port.

In detail, each data storage unit 262, 264, 266, and 268 including the dual-port RAM has ports A and B, which are independently accessible.

The data storage unit 262 receives the data signal DATA_ch1 and the clock signal CLK_ch1, which are output from the receiver RX1, and the write signal WREN_ch1 and the write address signal WRADDR_ch1, which are output from the corresponding write signal generator WG1, through the A-port 262*a*.

Then, the data storage unit 262 receives the read signal RDEN and the read address signal RDADDR, which are output from the read signal generator RG, and the clock signal CLK_ch1 through the B-port 262*b*.

The data signal DATA_ch1 is stored in the data storage unit 262 in response to the write signal WREN_ch1, the write address signal WRADDR_ch1, and the clock signal CLK_ch1 accessed through the A-port 262*a*.

In addition, the stored data signal DATA_ch1 is read out from the data storage unit 262 in response to the read signal RDEN, the read address signal RADDR, and the clock signal CLK_ch1 accessed through the B-port 262*b*.

The data storage unit 264 receives a data signal DATA_ch2 and the clock signal CLK_ch2, which are output from the corresponding receiver RX2, and the write signal WREN_ch2 and the write address signal WRADDR_ch2, which are output from the corresponding write signal generator WG2, through the A-port 264*a*.

Then, the data storage unit 264 receives the read signal RDEN and the read address signal RDADDR output from the read signal generator RG and the clock signal CLK_ch1 through the B-port 264*b*.

The data signal DATA_ch2 is stored in the data storage unit 264 in response to the write signal WREN_ch2, the write address signal WRADDR_ch2, and the clock signal CLK_ch2 accessed through the A-port 264*a*.

In addition, the stored data signal DATA_ch2 is read out from the data storage unit 264 in response to the read signal RDEN, the reading address signal RDADDR, and the clock signal CLK_ch1 accessed through the B-port 264*b*.

In detail, when the data signal DATA_ch2 is stored in the data storage unit 264, the data signal DATA_ch2 is stored in synchronization with the clock signal CLK_ch2. However, when the data signal DATA_ch2 is read out from the data storage unit 264, the data signal DATA_ch2 is read out in synchronization with the clock signal CLK_ch1 input to the A-port 262*a* of the data storage unit 262.

The remaining data storage units 266 and 268 have a similar structure and operation as that of the data storage units 262 and 264.

In other words, the data storage unit 266 stores a data signal DATA_ch3 in synchronization with a clock signal CLK_ch3, and the data signal DATA_ch3 is read out from the data storage unit 266 in synchronization with the clock signal CLK_ch1.

In addition, the data storage unit 268 stores a data signal DATA_ch4 in synchronization with a clock signal CLK_ch4, and the data signal DATA_ch4 is read out from the data storage unit 268 in synchronization with the clock signal CLK_ch1.

In brief, when data signals are stored in the corresponding data storage units, the data signals are stored in synchronization with clock signals belonging to corresponding signal groups. However, when the data signals are read out from the data storage units, the data signals are read out in synchronization with a clock signal (the clock signal CLK_ch1 according to the exemplary embodiment of the present invention) belonging to any one signal group.

Consequently, the signal control device 200 according to an exemplary embodiment of the present invention includes the dual-port RAM, which independently performs writing and reading processes, for each channel, to compensate for data skew between channels. In other words, the data storage units 262, 264, 266, and 268 provided according to the channels temporarily store data signals that are input at different time points. Additionally, the stored data signals are simultaneously read out from the data storage units in response to one clock signal (the clock signal CLK_ch1 per FIG. 2 and FIG. 3) and one read signal.

Figure 3:
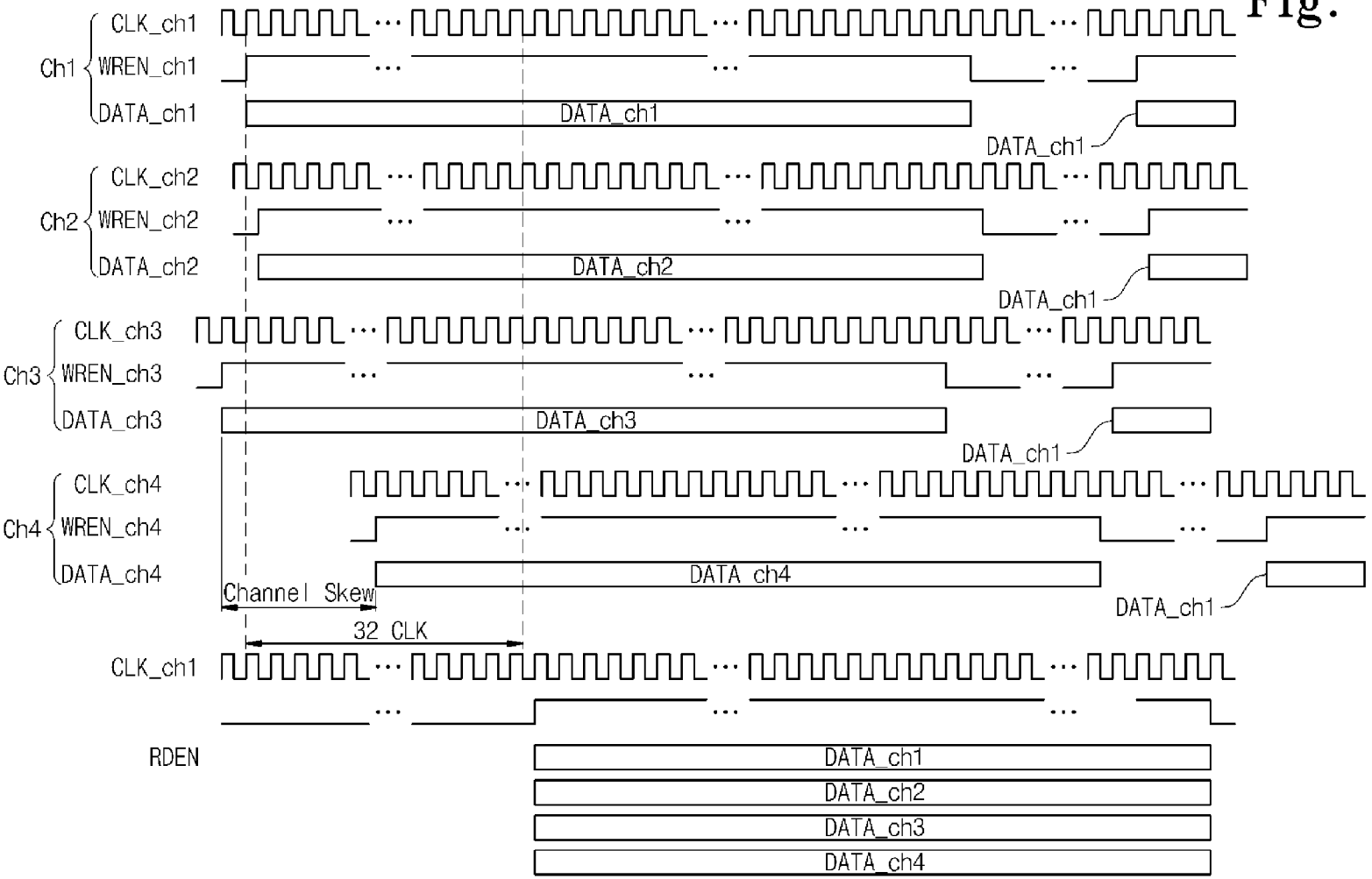
FIG. 3 is a timing diagram showing signals input to and output from the data storage units of FIG. 2.

FIG. 3 is a detailed timing diagram of signals shown in FIG. 2, and particularly shows the waveforms of signals written/read to/from the data storage units 262, 264, 266, and 268.

As shown in FIG. 3, the data signals are written to the data storage units 262, 264, 266, and 268 in response to clock signals CLK and activated write signals WREN of the data signal groups corresponding to the data signals.

The data signals written in the data storage units 262, 264, 266, and 268 are substantially simultaneously read out by the read signal RDEN generated from the read signal generator RG (see, FIG. 2) and the clock signal CLK_ch1.

In detail, the read signal RDEN is activated when a predetermined number of clock pulses of the clock signal CLK_ch1 have been counted. For example, the read signal RDEN may be activated when 32 clock pulses have been counted starting from an activation time point of the write signal WREN_ch1. Accordingly, the data signals written to the data storage units 262, 264, 266, and 268 may be aligned and read out by the activated read signal RDEN.

Although 32 clock pulses were set in the exemplary embodiment of FIG. 3, the set number of clock pulses may vary depending on the storage capacity of the dual-port RAM of the data storage units 262, 264, 266, and 268. As the dual-port RAM's storage capacity increases, the set number of clock pulses may also increase.

As described above, the signal control device 200 according to the present invention includes data storage units provided according to channels in order to compensate for the skew between the channels. In addition, the data signals stored in the data storage units are substantially simultaneously aligned and read out in synchronization with any one clock signal among the clock signals transmitted according to channels. Accordingly, the skew between the channels can be compensated.

Figure 4:
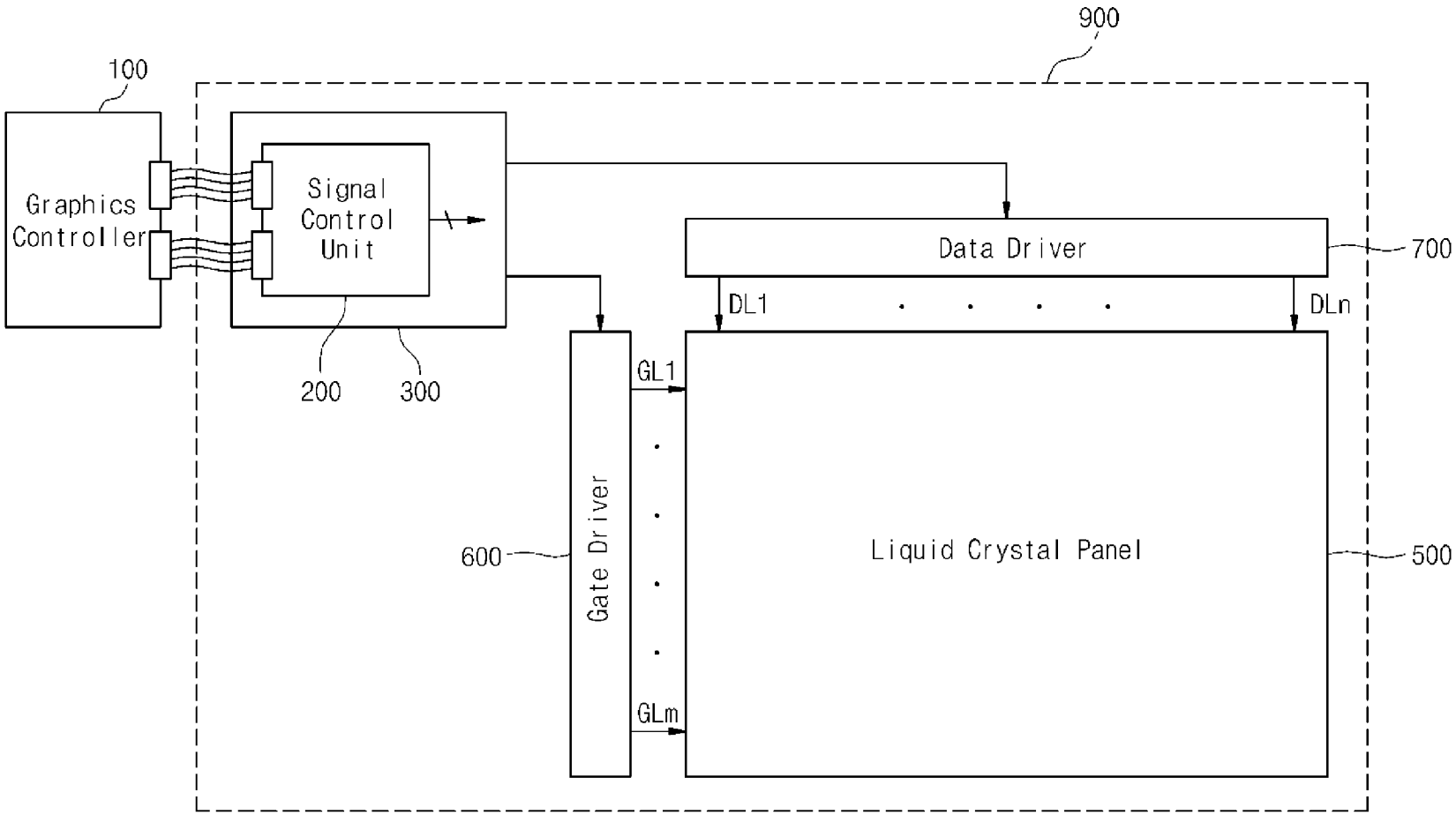
FIG. 4 is a block diagram showing a liquid crystal display including the signal control device of FIG. 1.

FIG. 4 is a block diagram showing a liquid crystal display according to an exemplary embodiment of the present invention.

Referring to FIG. 4, the liquid crystal display 900 includes a liquid crystal display panel 500 to display an image, drivers to drive the liquid crystal display panel 500, and a timing controller 300 to control the drivers.

The liquid crystal display panel 500 includes a first substrate having a common electrode and a second substrate having pixel electrodes, and liquid crystal is injected between the first and second substrates. The second substrate also includes a plurality of gate lines GL1 to GLm and a plurality of data lines DL1 to DLn, which cross each other with a predetermined interval.

The drivers include a gate driver 600 and a data driver 700. The gate driver 600 includes a plurality of gate driver ICs. The gate driver 600 applies a gate voltage to the gate lines GL1 to GLm of the liquid crystal display panel 500 in response to a control signal from the timing controller 300.

The data driver 700 includes a plurality of source driver ICs. The data driver 700 drives the data lines DL1 to DLn of the liquid crystal display panel 500 in response to a control signal and a data signal DATA input from the timing controller 300.

The timing controller 300 receives the data signal DATA and the clock signal CLK from the external graphics controller 100 through the channels ch1 to ch4 so as to transmit the data signal DATA and the clock signal CLK to the data driver 700.

In detail, the timing controller 300 receives red, green, and blue image data signals, a horizontal synchronization signal Hsync, a vertical synchronization signal Vsync, a clock signal MCLK, and a data enable signal DE from the external graphics controller 100.

The timing controller 300 outputs the control signal and the data signal DATA having a data format converted according to the requirement of the liquid crystal panel 500 to the data driver 700 and the gate driver 600.

The timing controller 300 includes a signal control unit 200 that compensates for skew caused by transmission delay occurring among the channels ch1 to ch4.

The signal control unit 200 selects one clock signal from among clock signals received according to the channels ch1 to ch4. Then, the data signals received according to the channels ch1 to ch4 are substantially simultaneously output in synchronization with the selected clock signal.

In detail, the signal control unit 200 includes the receivers 220, the controller 240, and the data storage units 260. The receivers 220, the controller 240, and the data storage units 260 of the signal control unit 200 have the same structure and operation as those shown in FIG. 2.

Accordingly, if those skilled in the art use technical information related to the structure and operation of the signal control device 200 shown in FIG. 2 as a reference, they may easily understand the description of the components of the signal control unit 200 of FIG. 4. Therefore, details of the components of the signal control unit 200 will be omitted in the following description.

A signal control unit 200 having the same structure and operation as the signal control device shown in FIG. 2 may be employed for the liquid crystal display 900 according to an exemplary embodiment of the present invention, so that display quality of the liquid crystal display 900 can be improved.

A method of inputting/outputting signals in a liquid crystal display, which processes signals received from an external system, will be described below.

Figure 5:
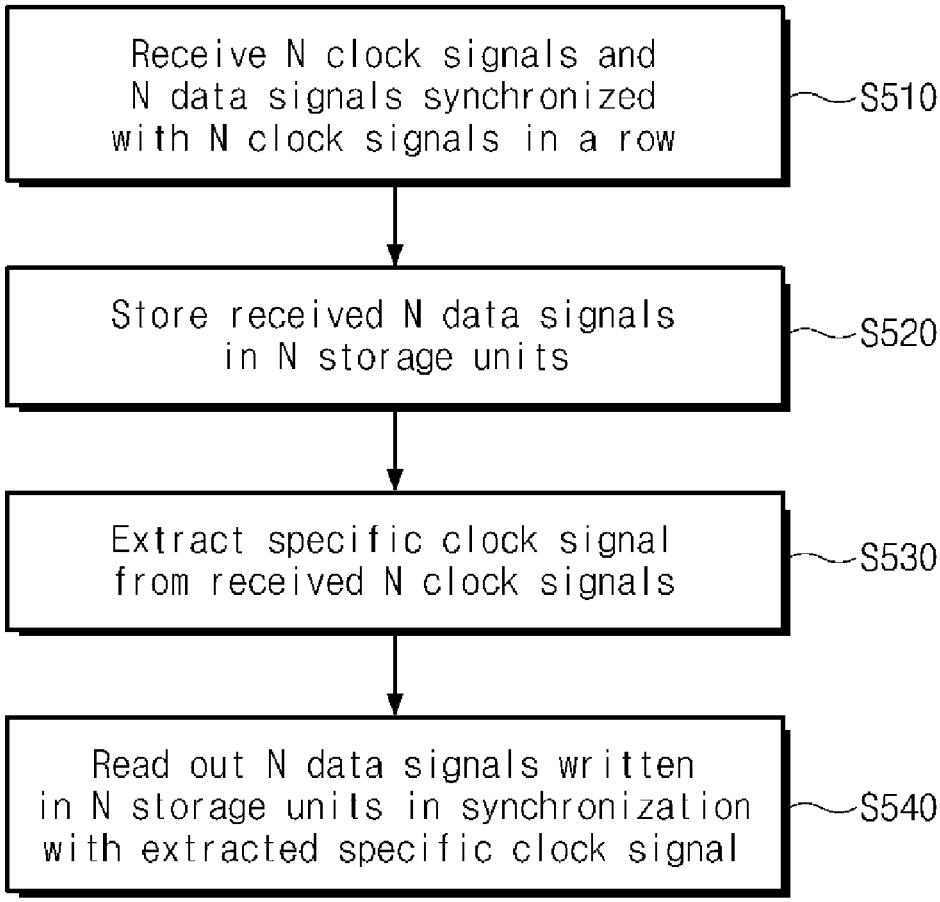
FIG. 5 is a flowchart showing a signal control method for the liquid crystal display according to an exemplary embodiment of the present invention.

FIG. 5 is a flowchart showing a signal control method in a liquid crystal display according to an exemplary embodiment of the present invention.

Referring to FIG. 5, the liquid crystal display 900 is electrically connected to an external system through N channels (herein, the N represents a natural number no less than 2), and N clock signals and N data signals synchronized with the N clocks signals are received from the external system in a row (S510). The N clock signals and the N data signals received according to channels arrive at the liquid crystal display 900 at different times due to the skew occurring between the channels. The external system may be the graphic controller 100 shown in FIG. 1.

The received N data signals are written to N storage units in a row in the order of reception time of the N data signals (S520).

Thereafter, one clock signal is extracted from the N clock signals received together with the N data signals through the channels (S530). Then, the N data signals written in the N storage units are output substantially simultaneously in synchronization with the extracted clock signal (S540). In detail, a number of reference clock pulses of the extracted clock signal is preset, and the N data signals written in the data storage units are output substantially simultaneously when the reference number of clock pulses has been counted.

According to the above, the liquid crystal display is electrically connected to the external graphics controller through channels. In this case, the data storage units are provided according to the channels. The data signals stored in the data storage units are substantially simultaneously read out in synchronization with any one clock signal among clock signals transmitted according to the channels. Accordingly, skew occurring between the channels can be compensated.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A signal control device, comprising:

a plurality of receivers, each receiver to receive a data signal, a clock signal, and a data enable signal through a corresponding channel among a plurality of channels and to output the data signal, the clock signal, and the data enable signal;

a plurality of data storage units, each data storage unit to receive the data signal and the clock signal output from a corresponding receiver among the receivers, to store the data signal in response to a corresponding write signal among a plurality of write signals, and to output the stored data signal by commonly responding to an activated read signal; and a controller to provide the activated read signal to the data storage units in response to a data enable signal and any one clock signal transmitted through any one channel of the channels, and to provide the write signals to the data storage units while reading out the data signals from the data storage units.

2. The signal control device of claim 1, wherein the controller comprises:

a plurality of write signal generators connected between the receivers and the data storage units to generate the write signals in response to the clock signals and the data enable signals output from corresponding receivers, and to provide the write signals to the data storage units; and a read signal generator connected to one write signal generator of the write signal generators to receive both the any one clock signal and the data enable signal, which are input to the one write signal generator, and to commonly provide the activated read signal to the data storage units.

3. The signal control device of claim 2, wherein each data storage unit comprises a first port and a second port, which are independently accessible, and in which the first port is accessed by a write signal generated from a corresponding write signal generator, and the second port is accessed by the activated read signal.

4. The signal control device of claim 1, wherein the activated read signal is activated when a number of clock pulses of the any one clock signal reaches a preset number.

5. The signal control device of claim 4, wherein the preset number of clock pulses is 32.

6. The signal control device of claim 5, wherein each data storage unit comprises a dual-port random access memory (RAM).

7. The signal control device of claim 6, wherein the preset number of clock pluses corresponds to a storage capacity of the dual-port RAM.

8. A liquid crystal display, comprising:

a liquid crystal display panel to display an image in response to driving signals;

a driver to provide the driving signals to the liquid crystal display panel in response to converted data signals and converted clock signals; and a timing controller to receive data signals and clock signals through a plurality of channels and to output the converted data signals and the converted clock signals to the driver, wherein the timing controller includes a signal control unit, the signal control unit comprising:

a plurality of receivers, each receiver to receive a data signal among the data signals, a clock signal among the clock signals, and a data enable signal through a corresponding channel among the channels and to output the data signal, the clock signal, and the data enable signal;

a plurality of data storage units, each data storage unit to receive the data signal and the clock signal output from a corresponding receiver among the receivers, to store the data signal in response to a corresponding write signal among a plurality of write signals, and to output the stored data signal in response to an activated read signal; and a controller to provide the activated read signal to the data storage units in response to a data enable signal and any one clock signal transmitted through any one channel of the channels, and to provide the write signals to the data storage units while the data signals being read out from the data storage units.

9. The liquid crystal display of claim 8, wherein the controller comprises:

a plurality of write signal generators connected between the receivers and the data storage units to generate the write signals to be provided to the data storage units in response to the clock signals and the data enable signals output from corresponding receivers; and a read signal generator connected to one write signal generator of the write signal generators to receive both the any one clock signal and the data enable signal input to the one write signal generator, and to commonly provide the activated read signal to the data storage units.

10. The liquid crystal display of claim 8, wherein the activated read signal is activated when a number of clock pulses of the any one clock signal reaches a preset number.

11. The liquid crystal display of claim 9, wherein the preset number of clock pulses is 32.

12. The liquid crystal display of claim 10, wherein each data storage unit comprises a dual-port random access memory (RAM).

13. The liquid crystal display of claim 11, wherein the preset number of clock pulses corresponds to a storage capacity of the dual-port RAM.

* * * * *